US005711678A

United States Patent [19]

Wu

[11] Patent Number: 5,711,678

[45] Date of Patent: Jan. 27, 1998

[54] HIGH PIN DENSITY ELECTRICAL CONNECTOR STRUCTURE

[75] Inventor: Kun-Tsan Wu, Tu-Chen, Taiwan

[73] Assignee: Hon Hai Precision Ind. Co., Ltd., Taiwan

[21] Appl. No.: 570,122

[22] Filed: Dec. 11, 1995

[51] Int. Cl.[6] ..... H01R 9/09

[52] U.S. Cl. ..... 439/79

[58] Field of Search ..... 439/79, 80, 741, 439/743, 733.1, 682, 692, 603

[56] References Cited

U.S. PATENT DOCUMENTS

| | | | |
|---|---|---|---|
| 3,348,191 | 10/1967 | Kinkaid | 439/741 |
| 5,104,326 | 4/1992 | Smith et al. | 439/79 |
| 5,184,963 | 2/1993 | Ishikawa | 439/79 |

*Primary Examiner*—Neil Abrams
*Assistant Examiner*—Barry Mathew L. Standig

[57] ABSTRACT

A high pin density electrical connector includes an insulation body having a first surface and a second surface, a metal shield mounted to the first surface of the insulation body, having a plate portion and a shaped frame integrally formed on the plate portion to define a circumferentially surrounded space and a plurality of pin members. The insulation body has two recesses formed on the second surface thereof and a plurality of pin receiving holes formed on a central portion thereof, extending from the first surface to the second surface and having a configuration of figure "8" to receive therein the pin members so as to have a flat leading section of each of the pin members extending into the surrounded space of the shield. The pin members have an intermediate section connected to the leading section along a longitudinal direction to engage and secure within the pin receiving holes and a tailing section having a pin leg to electrically connect to a printed circuit board.

16 Claims, 6 Drawing Sheets

HIGH PIN DENSITY ELECTRICAL CONNECTOR STRUCTURE

FIELD OF THE INVENTION

The present invention relates generally to an electrical connector and in particular to an electrical connector having a compact, concise and dense pin arrangement particularly suitable for use in miniature computerized office machines.

BACKGROUND OF THE INVENTION

Conventionally, the communication connection between a computer and peripheral devices is done via the so called D-type connector which has a plurality of pins with a spacing between adjacent pins approximately equal to 2.54 min. Such an electrical connector is the most widely used electrical connector for computers and associated devices. Due to the fact that the pins of this connector are arranged in a sparse manner (or referred to as low pin density), the connector occupies a large surface area on a printed circuit board which the connector engages. Such a low pin density connector is quite obviously not suitable for use in miniature office machines, such as notebook computer, which requires the pins of the connector to be arranged in a more compact and denser manner.

Further, in the conventional electrical connector structure, in order to have the pins thereof to be securely mounted to an insulation body for retaining and supporting the pins, each of the pins is provided with a large hook on a predetermined section thereof, which hook engages an associated hole formed on the insulation body in a destructive fitting manner to retain the pin on the insulation body. Such a design is not applicable to a high pin density electrical connector, for use in a high pin density electrical connector, in order to accommodate more pins in a smaller area, the partition between two adjacent pin holes which the hooks of two adjacent pins engage has to have a reduced thickness which may be seriously damaged during the destructive fitting process and thus the electrical insulation between the two pins may be damaged to such an extent that when a high voltage or current is applied to the pins, a short circuit may occur.

Solving such a problem by simply reducing the size of the pins or increasing the partition wall thickness between two adjacent pin holes is not feasible, because the former reduces the contact area that is available on the pin terminal and may thus cause signal transfer problem and the latter increases the overall surface area occupied by the electrical connector and thus not suitable for miniature office machines.

It is therefore desirable to provide a high pin density electrical connector structure which overcomes the problems.

SUMMARY OF THE INVENTION

The principal object of the present invention is to provide a high pin density electrical connector structure which comprises a compact, concise and dense arrangement of pins, particularly suitable for use in miniature office machines and allowing the pins to be secured on an insulation body at the same time when the pins are assembled to the insulation body without any structural damage to the insulation body.

It is another object of the present invention to provide an electrical connector which can be alternatively used in either a vertical connection manner or a horizontal connection manner with mated coupling devices so as to provide options in how to use the connector.

It is a further object of the present invention to provide an electrical connector incorporating retainer members which guides the assembly of the electrical connector in a more effective manner and provides a better capability to retain parts of the electrical connector together.

Thus, in accordance with the present invention, a high pin density electrical connector incorporating a plurality of pins is provided, in which each of the pins has a leading terminal section with a central reduced waist defined by two opposite arcuate concave sides, an intermediate section connected to the leading section along a longitudinal direction and having at least two segments, each separated by a raised-recessed structure comprising a raised portion and a recessed portion juxtaposed each other along a lateral direction that is substantially normal to the longitudinal direction, and a tailing section which has a twisted front segment connected to the intermediate section along the longitudinal direction and a non-twisted rear leg segment. The connector further comprises an insulation body on which a plurality of holes, each corresponding to one of the pins, is formed and configured as the figure "8" for receiving and effectively securing the pin therein.

In accordance with a second aspect of the present invention, the insulation body adapted in the high pin density connector of the present invention comprises a plate member having a first surface and an opposite second surface wherein the second surface has formed on each of two opposite lateral sides a recessed positioning slot to each receive therein a retainer either vertically or horizontally so as to allow the connector to be optionally used in a vertical coupling manner or a horizontal coupling manner.

BRIEF DESCRIPTION OF THE DRAWINGS

The present invention will be better understood from the following description of an illustrative but non-limitative preferred embodiment of the present invention, with reference to the attached drawings, wherein.

DETAILED DESCRIPTION OF THE PREFERRED EMBODIMENT

Figure 1:
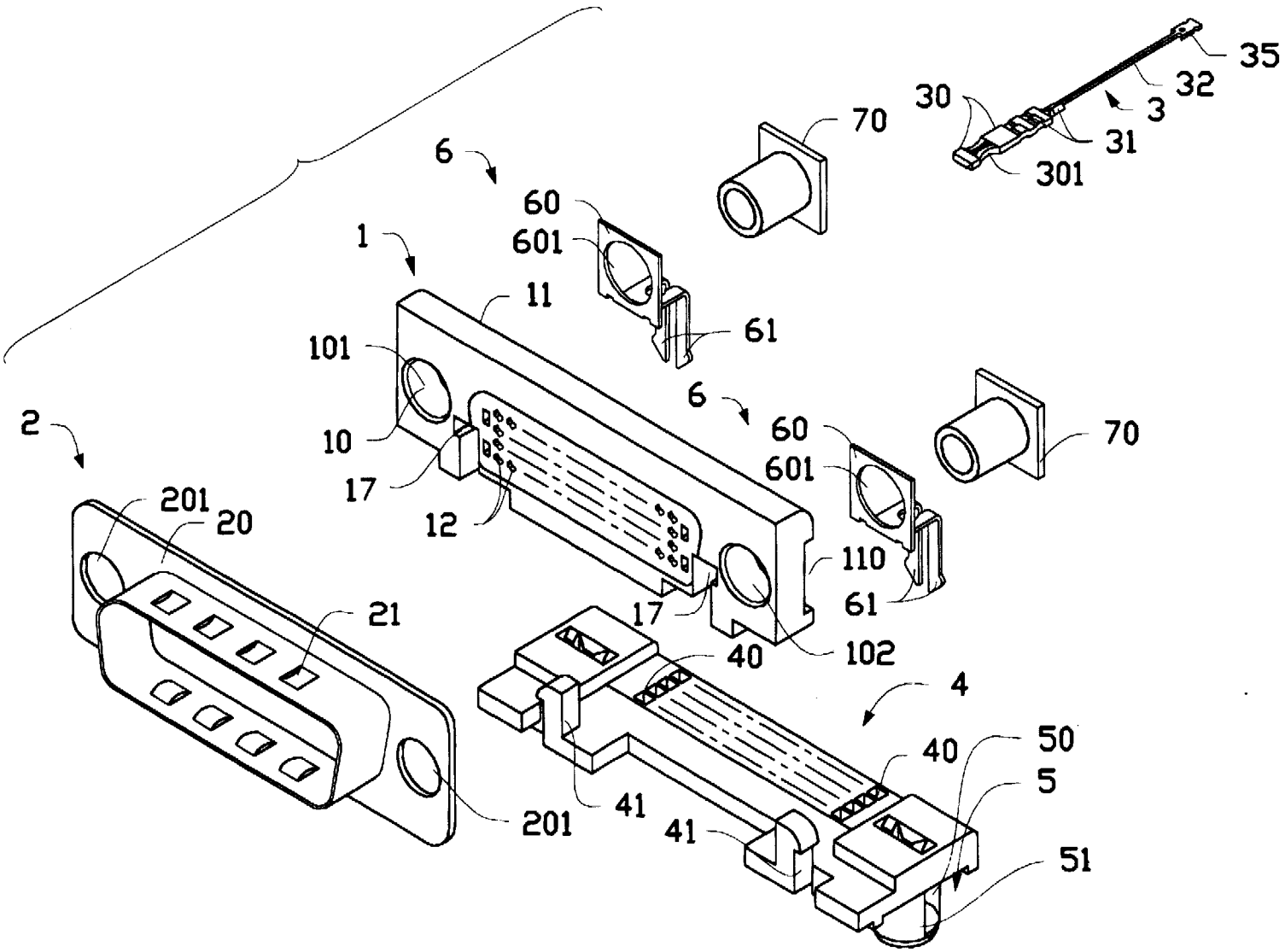
FIG. 1 is an exploded perspective view showing a high pin density electrical connector constructed in accordance with the present invention.

With reference to the drawings and in particular FIG. 1, wherein a high pin density electrical connector constructed in accordance with the present invention is shown, the high pin density electrical connector, as illustrated in FIG. 1, comprises an insulation body 1, a shield 2, preferably made of a metal, a plurality of conductive pin members 3 (only one being shown in the drawings for simplicity), a pin leg securing device 4 with a guiding member 5 and two retainers 6. The insulation body 1 is in general a plate having a first surface 10, located on the front side as viewed in FIG. 1, with a hole 101 or 102 formed on each of two opposite lateral sides thereof for receiving and retaining therein one of the retainers 6 which comprise a pair of retaining legs 61 (to be described in detail hereinafter) for securing the high pin density electrical connector to a printed circuit board (not shown).

The insulation body 1 further has a second surface 11, opposite to the first surface 10 thereof and thus located on the rear side as viewed in FIG. 1. The second surface 11 of the insulation body 1 has formed on each of two opposite lateral sides thereof a recess 110, associated with one oft he holes 101 and 102 to provide initial positioning of the respective retainer 6.

It is to be noted that since the body 1 has no plateaus extending rearward at two lengthwise opposite ends thereof as most conventional right angle electrical connectors to limit the extension of the retaining legs 61, the direction along which the retaining legs 61 of the retainer 6 extend may be set to either vertical or horizontal without any limitation. This allows the electrical connector to be coupled to a mated member in either a vertical or horizontal manner.

Figure 5:
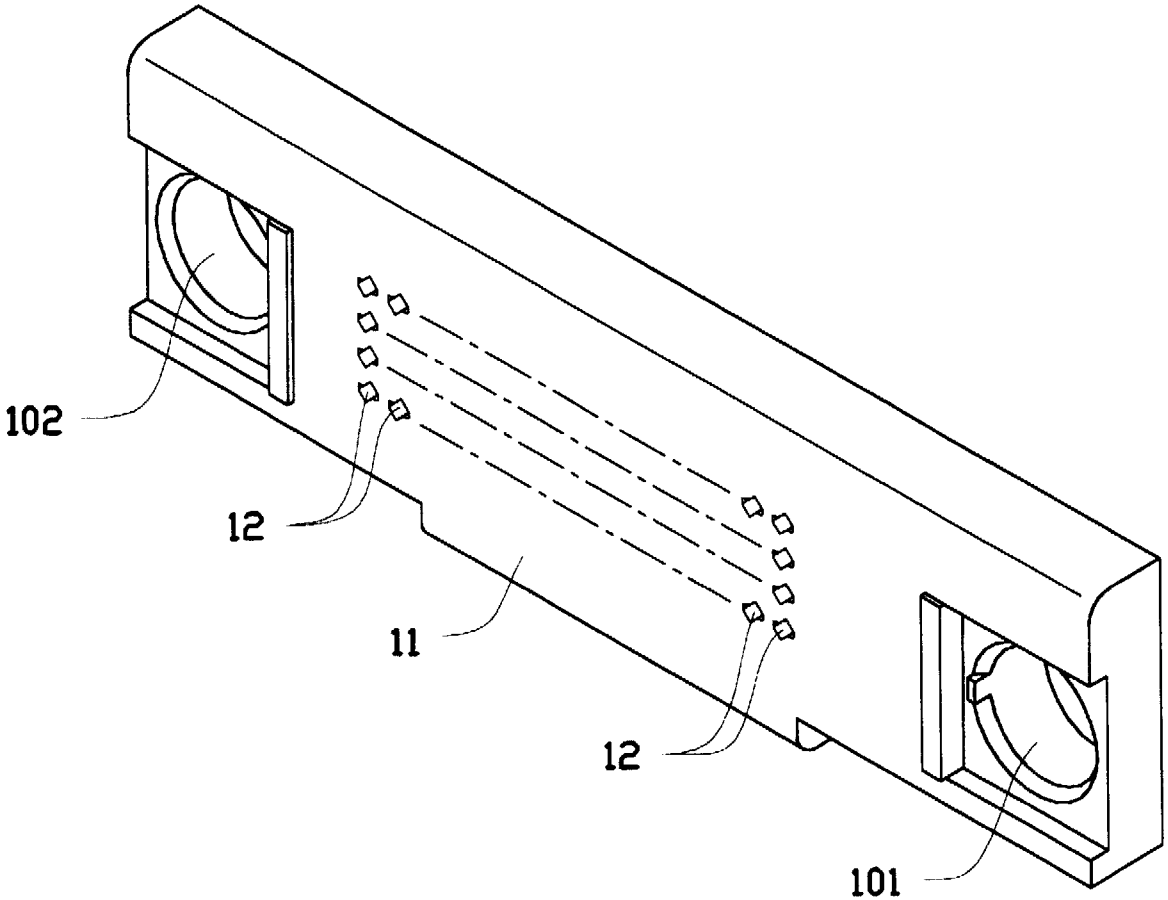
FIG. 5 is a perspective rear view of the insulation body adapted in the high pin density electrical connector, showing the second surface thereof.
Figure 6:
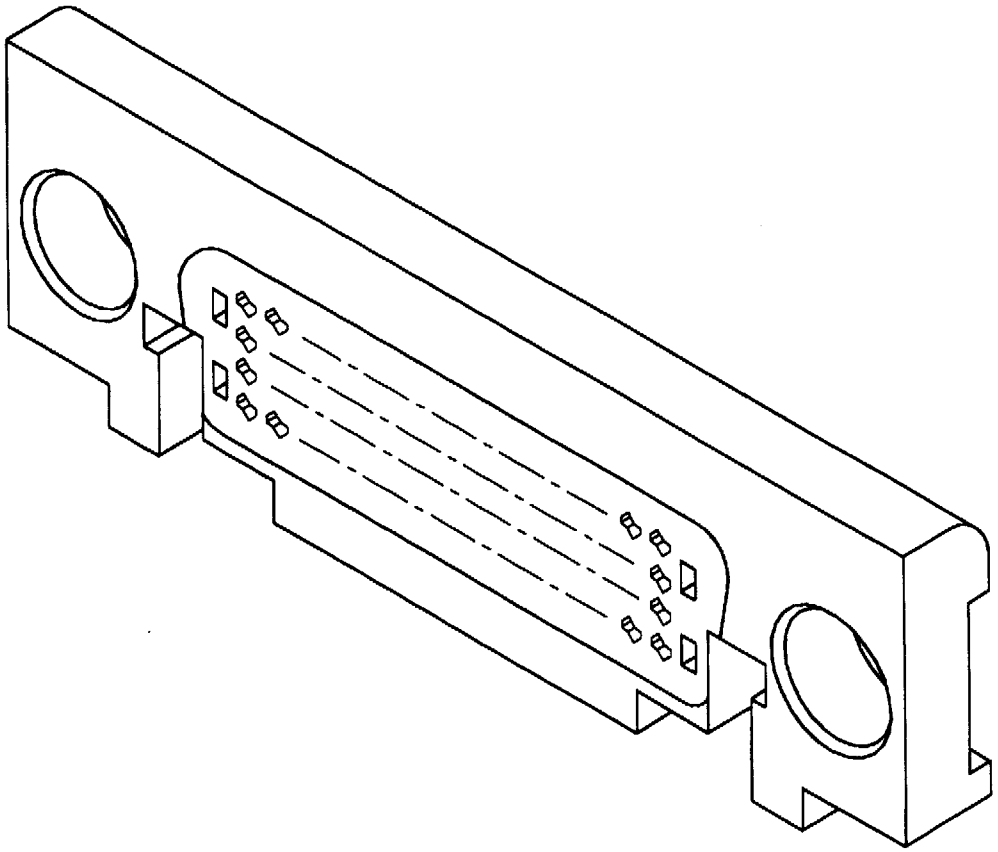
FIG. 6 is a perspective front view of the insulation body.

The insulation body 1 has formed on a central portion thereof a plurality of pin receiving holes 12 which extend from the first surface 10 to the second surface 11 and thus across the thickness of the insulation body 1. The pin receiving holes 12 have the configuration of figure "8", as shown in FIG. 5, which is a perspective view of the insulation body 1 observed from the second surface 11 thereof. Each of the pin receiving holes 12 has one of the pin members 3 extend therethrough and also retain the pin member 3 therein. This will be further discussed hereinafter.

Figure 2:
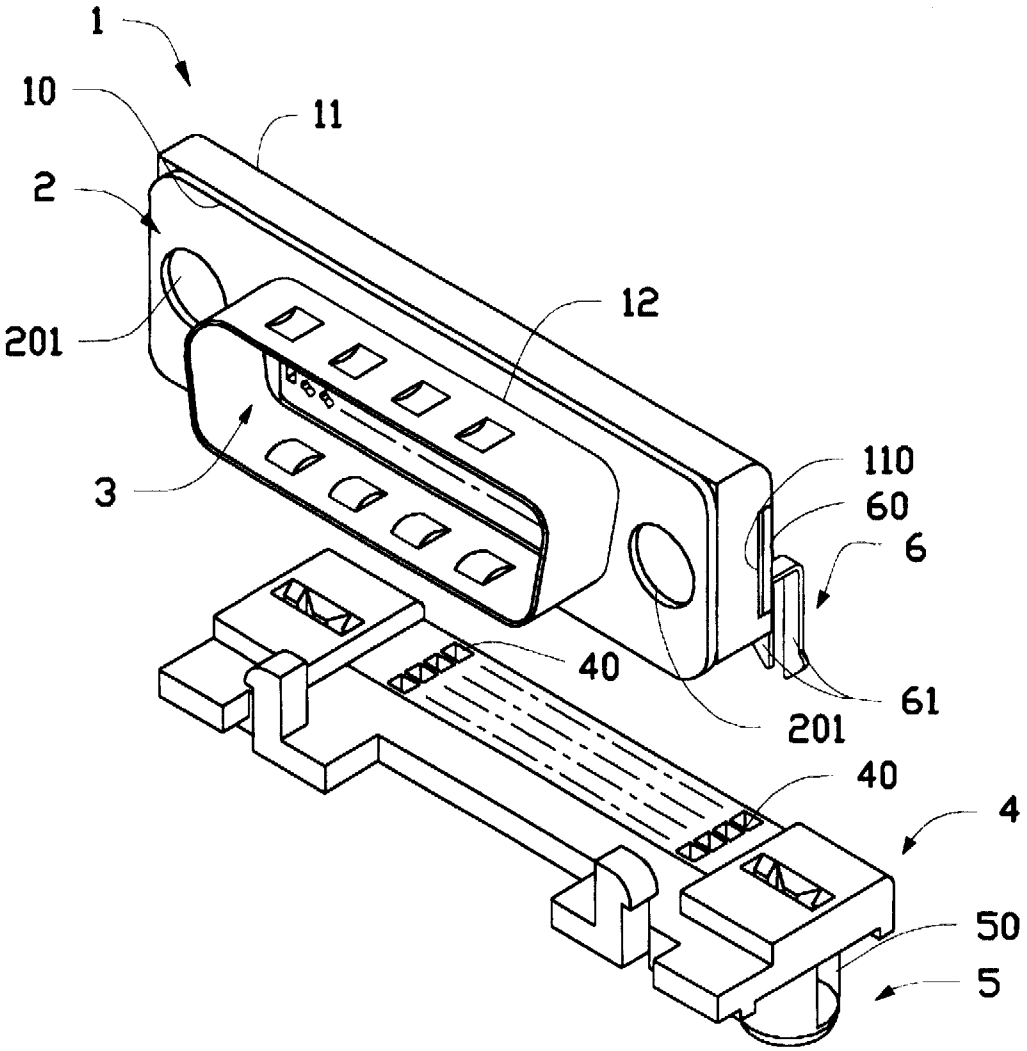
FIG. 2 is a perspective view of the high pin density electrical connector of the present invention, showing the situation where the pin leg securing device is not secured to the insulation body and the retainers.
Figure 3:
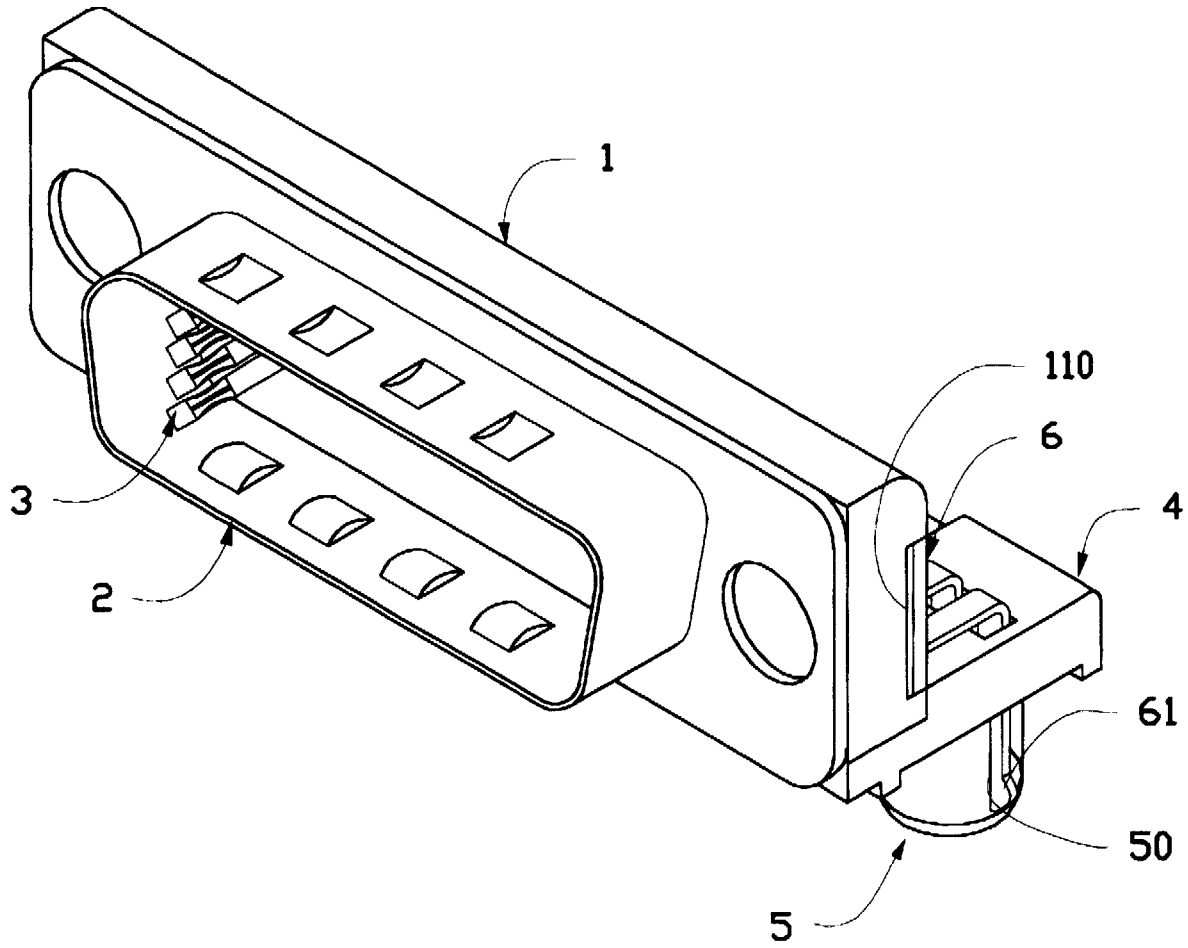
FIG. 3 is a perspective view of the assembled high pin density electrical connector of the present invention.

The shield 2 is preferably made of a metal plate to define a plate portion 20 to be disposed against and thus shielding the first surface 10 of the insulation body 1, having an opening with a shaped frame 21 secured thereto, forming a circumferential wall surrounding the opening and defining a space for accommodating leading terminal sections 30 of the pin members 3 therein. The plate portion 20 of the shield 2 has formed thereon two holes 201, each corresponding to one of the holes 101 and 102 of the insulation body 1 to allow a fastener 70 to extend through both the hole 201 and the hole 101 (or 102) of the insulation body 1 for securing the shield 2 on the first surface 10 of the insulation body 1. The shield 2 is so secured to the insulation body 1 that the opening of the plate portion 20 of the shield 2 and the space surrounded and defined by the shaped frame 21 aligned with the central portion of the insulation body 1 in which the pin receiving holes 12 are formed so that the pin members 3 that extend through the holes 12 have the leading terminal sections 30 thereof located within the space defined by the shaped frame 21 of the shield 2, as shown in FIG. 2 and 3.

Figure 4:
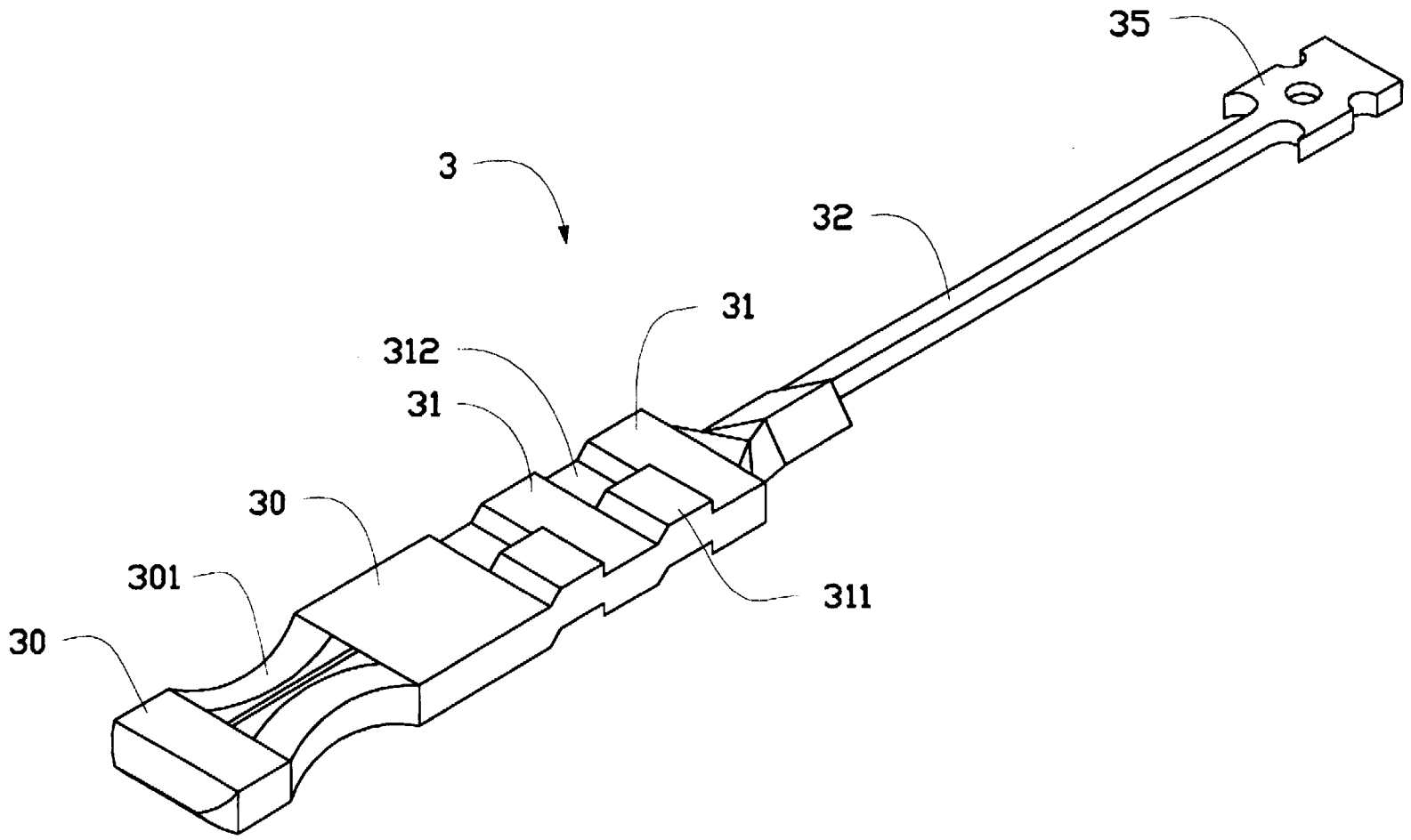
FIG. 4 is a perspective view showing an embodiment of the pin adapted in the high pin density electrical connector of the present invention with a residual blank material remained on the rear end thereof to be detached later after the assembly of the electrical connector is completed.

FIG. 4 shows an enlarged perspective view of the pin members 3 which comprise an elongated body formed by means of continuous mold pressing of a metal plate made of a material of electrical conductivity. A residual blank material 35 remains attached to a tailing section 32 of the pin member 3 illustrated in the drawings which is to be cut off once the assembly of the electrical connector is completed. The pin members 3 comprise a flat, leading terminal section 30 with a central, reduced waist 301 defined by two opposite arcuate concave sides, as illustrated, an intermediate section 31 connected along a longitudinal direction to the leading section 30 and having at least two segments each separated by a raised-recessed structure comprising a raised portion 311 and a recessed portion 312 juxtaposed each other along a lateral direction substantially normal to the longitudinal direction and a tailing section 32 defining a pin leg. In assembly to the pin receiving holes 12 of the insulation body 1, the leading section 30 of each of the pin members 3 is inserted into the respective pin receiving hole 12 in a slightly inclined manner relative to a horizontal axis of the pin receiving hole 12 to such an extent that the leading section 30 extends into the space defined by the shaped frame 21 of the shield 2 to serve as a coupling pin of the electrical connector. The intermediate section 31 is located within the respective pin receiving hole 12 and retained therein by means of the raised-recessed structure mating and engaging the figure "8" configuration of the pin receiving hole 12. The tailing section 32 that defines the pin leg is inserted into and secured on an associated one of a plurality of holes 40 formed on the pin leg securing device 4.

The pin leg securing device 4 comprises a plate member made of an insulation material on which the plurality of positioning holes 40 are formed to respectively receive and retain therein the pin leg defined on the tailing section 32 of each of the pin members 3. On a front side of the pin leg securing device 4, a pair of paw members 41 are formed and extending to define a hooked free end to be in engagement with a corresponding shoulder or slot 17 formed on the insulation body 1 so as to secure the pin leg securing device 4 to the insulation body 1.

Further, the plate of the pin leg securing device 4 has formed on each of two lateral sides thereof a guiding member 5 which comprises a cylinder depending from a lower surface of the plate 4, with a through slot 50 which extends completely through the cylinder 5 in a lateral direction to define two lateral openings on a cylindrical outer surface of the guiding member 5. The slot 50 also extends upward to define an upper opening on an upper surface of the plate 4 for the entry of the retaining legs 61 of the respective retainer 6.

The cylinder of each of the guiding members 5 has a chamfer 51 formed on a free end thereof for guiding the insertion of the cylinders of the guiding members 5 into holes formed on a printed circuit board (not shown) to establish physical connection with the printed circuit board. The electrical connection between the electrical connector and the printed circuit board is provided by the pin legs of the pin members 3.

Each of the retainers 6 that engages the respective recess 110 formed on the second surface 11 of the insulation body 1 is preferably made of a metal of desired elasticity, comprising a plate 60 with a central through hole 601 formed therein to receive the fastener 70 extending therethrough. The fastener 70, as mentioned above, also extends through the respective hole 101 or 102 of the insulation body 1 and the respective hole 201 of the shield 2 to secure the retainer 6, the insulation body 1 and the shield 2 together. Each of the retainers 6 further comprises a pair of retaining legs 61, each having a hooked free end extending downward into the slot 50 of the respective cylinder of the guiding member 5 through the upper opening of the slot 50 to have the hooked ends of the retaining legs 61 partially protruding out of the slot 50 via the lateral openings of the slot 50. The elasticity of the material that makes the retainer 6 provides the retaining legs 61 with a resiliency which allows the retaining legs 61 to resiliently engage a printed circuit board (not shown) for securing the electrical connector of the present invention to the printed circuit board.

The fastener 70 is preferably a rivet which has an inner threaded hole to engage a mated coupling member or a corresponding connection member.

In assembly, the shield 2 is first disposed onto the first surface 10 of the insulation body 1 and the pin members 3 are inserted one by one into the figure "8" configured pin receiving holes 12 of the insulation body 1 to have the leading section 30 thereof extend out of the first surface 10 and located within the space defined by shaped frame 21 of the shield 2. The retainers 6 are then respectively disposed into the recesses 110 that are formed on the second surface 11 of the insulation body 1 with the fasteners 70 extending through the holes 601 of the retainers 6, the holes 101 and 102 of the insulation body 1 and the holes 201 of the shield 2 to secure these members 6, 1 and 2 together, as shown in FIG. 2.

Thereafter, the pin legs 32 of the pin members 3 are forced to insert into the positioning holes 40 of the pin leg securing device 4 and the retaining legs 61 of the retainers 6 into the slots 50 of the guiding members 5 and further allowing the hooked upper ends of the paw members 41 of the pin leg securing device 4 to engage the corresponding slots 17 of the insulation body 1 to complete the assembly of the pin leg securing device 4 to the insulation body 1, as shown in FIG. 3.

To this point, through the above description, it is understood that due to the novel design of the figure "8" configured pin receiving holes 12 and the correspondingly shaped pin members 3, the high pin density electrical connector of the present invention provides a compact, concise and dense arrangement of the terminal pins that suits the requirement of the miniature office machines. Further, the design of the recesses 110 on the second surface 11 of the insulation body 1 provides the options to use the electrical connector of the present invention to be connected in a horizontal manner (i.e., right angle) or a vertical manner. It can be seen that in the invention the insulation body 1 has no plateaus integrally extending rearward from the second surface 11 on two opposite ends as most conventional right angle type connectors did for holding the corresponding right angle board-locks thereto, for example, U.S. Pat. No. 4,721,473. Thus, the insulation body itself may be used directly in a vertical manner as show in U.S. Pat. No. 5,407,364. Alternatively, by cooperation with the securing device 4, the insulation body 1 of the invention may function as a right angle type connector as most conventional right angle type connectors do wherein the conventional right angle type connectors has the integrally rearward extending plateaus on two sides just like the aforementioned U.S. Pat. No. 4,721,473. Therefore, the structure of the invention provides more options for mounting to the PC board than the prior arts.

It is apparent that although the invention has been described in connection with the preferred embodiment, it is contemplated that those skilled in the art may make changes to the preferred embodiment without departing from the scope of the invention as defined in the appended claims.

What is claimed is:

1. An electrical connector comprising:

an insulation body, having a first surface and an opposite second surface with a plurality of figure "8" configured pin receiving holes formed on a central portion of insulation body and extending across from the first surface to the second surface, in a slightly inclined manner with regard to a horizontal axis parallel to said surfaces;

a shield having a plate portion disposed against the first surface of the insulation body and having an opening to expose the central portion of the insulation body, a shaped frame formed integrally with the plate portion to surround the opening as a circumferential wall and define therein a space with the pin receiving holes of the insulation body located within the space;

a plurality of electrically conductive pin members, respectively having a flat leading section of each of the pin members extending into the space defined by the shaped frame of the shield for electrical and mechanical engagement with an exterior coupling device, each of the pin members having an intermediate section connected along a longitudinal direction to the leading section and comprising engaging means for compliance with the configuration of the respective pin receiving hole for securely retaining the pin member within the pin receiving hole, in the same inclined manner for highly dense arrangement and a tailing section extending longitudinally from the intermediate section and comprising a leg segment.

2. The electrical connector as claimed in claim 1, wherein the leading section of each of the pin members comprises a central, reduced waist defined by two juxtaposed and opposite, arcuate concave sides, wherein the intermediate section of each of the pin members comprises at least two segments, each separated by a raised-recessed structure comprising a raised portion and a recessed portion which are juxtaposed along a lateral direction normal to the longitudinal direction of the segments to define the engaging means and wherein the tailing section comprises a twisted segment connected to the intermediate section along the longitudinal direction and followed by the leg segment.

3. The electrical connector as claimed in claim 1, further comprising a pin leg securing device having a plurality of positioning holes formed thereon to respectively receive and retain therein the pin leg of the tailing section of the respective pin member.

4. The electrical connector as claimed in claim 3, wherein the pin leg securing device comprises paw members formed thereon, each having a hooked free end to engage an engaging slot formed on the insulation body for securing the pin leg securing device to the insulation body.

5. The electrical connector as claimed in claim 3, wherein the pin leg securing device comprises a plate member having an upper surface and a lower surface, the pin leg securing device having guiding means formed on the lower surface thereof, the guiding means comprises a projection mounted to and extending from each of two lateral sides of the lower surface, the projection having a slot formed thereon to define two lateral openings on an outer surface of the projection and a top opening on the upper surface of the plate member of the pin leg securing device.

6. The electrical connector as claimed in claim 5, wherein each of the projections of the guiding means comprises a chamfer formed on a free end thereof.

7. The electrical connector as claimed in claim 1, wherein the insulation body has holes formed thereon and the shield has corresponding holes formed thereon to receive a fastener extending through the holes of the insulation body and the shield for retaining the shield on the insulation body.

8. The electrical connector as claimed in claim 1, wherein the second surface of the insulation body has recesses formed thereon to receive therein releasable retaining means adapted to releasably retain the electrical connector on a circuit board.

9. The electrical connector as claimed in claim 5, wherein the second surface of the insulation body has two recesses formed thereon to receive therein releasable retaining means adapted to releasably retain the electrical connector on a circuit board, the releasable retaining means comprising two pairs of resilient legs respectively extending from the two recesses of the insulation body to be received in the slots of the guiding means through the top opening of the upper surface of the plate member to have the resilient legs partially protrude out of the lateral openings of the slot.

10. The electrical connector as claimed in claim 7, wherein the second surface of the insulation body has two recesses formed thereon to receive therein releasable retaining means adapted to releasably retain the electrical connector on a circuit board, the releasable retaining means comprising two retainer members, each having a plate portion with a through hole to receive the fastener extending therethrough to secure the retainer member on the insulation body and a pairs of resilient legs extending from the plate portion to be received in the slot of the guiding means through the top opening of the upper surface of the plate member to have the resilient legs partially protrude out of the lateral openings of the slot.

11. An electrical connector assembly comprising:

an insulation body having a first surface and an opposite second surface both defining a plurality of pin receiving holes side by side extending therebetween and therethrough; and a plurality of electrically conductive pin members respectively received within the corresponding pin receiving holes; wherein said housing substantially includes an insulation body without any redundant plateau formed on and extending from two opposite ends thereof along a longitudinal direction to support a right angle retainers therewith, and said housing further includes means for latchingly engagement with a securing device which comprises a plate member for not only aligning pin legs of the pin members, but also supporting at least a right angle retainer therewith, whereby the housing can function as either a vertically connecting connector without the securing device attached thereto or a horizontally connecting connector with the securing device attached thereto.

12. The electrical connector assembly as defined in claim 11, wherein the means of the housing are a pair of slots for receiving a corresponding pair of paw members of the securing device for retaining the securing device with regard to the housing.

13. The electrical connector assembly as defined in claim 11, wherein said plate member of the securing device comprises a plurality of positioning holes for receiving and retaining the pin legs of the pin members therein, respectively, and further comprises a pair of guide members on two opposite sides for incorporating retaining legs of the retainer.

14. An electrical connector comprising:

an insulation body having a first surface and an opposite second surface with a plurality of figure "8" configured pin receiving hole side by side extending fully therebetween;

a plurality of electrically conductive pin members respectively received in the corresponding pin receiving holes of the insulation body; wherein each of said pin members includes a leading section extending forward from the first surface, an intermediate section connected along a longitudinal direction to the leading section, and a tailing section extending rearward from the intermediate section; wherein said intermediate section includes engaging means having at least a segment separated by a raised-recessed structure comprising a raised portion and a recessed portion which are juxtaposed along a lateral direction normal to the longitudinal direction of the segment in compliance with said construction "8" of the corresponding pin receiving hole for retainingly engagement.

15. An electrical connector comprising:

an insulation body, having a first surface and an opposite second surface with a plurality of figure "8" configured pin receiving holes formed on a central portion of insulation body and extending from the first surface to the second surface;

a shield having a plate portion disposed against the first surface of the insulation body and having an opening to expose the central portion of the insulation body, a shaped frame formed integrally with the plate portion to surround the opening as a circumferential wall and define therein a space with said first surface, and the pin receiving holes of the insulation body connected with the space;

a plurality of electrically conductive pin members, respectively having a flat leading section extending from the first surface into the space which is defined by the shaped frame and said first surface, each of the pin members having an intermediate section connected along a longitudinal direction to the leading section and comprising engaging means in compliance with said configuration "8" of the respective pin receiving hole for securely retaining the pin member within the pin receiving hole and a tailing section extending longitudinally from the intermediate section and comprising a leg segment.

16. An electrical connector comprising:

an insulation body having a first surface and an opposite second surface with a plurality of figure "8" configured pin receiving hole side by side extending fully therebetween;

a plurality of electrically conductive pin members respectively received in the corresponding pin receiving holes of the insulation body; wherein each of said pin members includes a leading section extending forward from the first surface, an intermediate section connected along a longitudinal direction to the leading section, and a tailing section extending rearward from the intermediate section; wherein said leading section comprises a central, reduced waist which is defined by two juxtaposed and opposite, arcuate concave sides.

* * * * *